United States Patent [19]

Liao

[11] Patent Number: 4,639,323

[45] Date of Patent: Jan. 27, 1987

[54] WATER SOLUBLE METALWORKING FLUIDS

[75] Inventor: Tsong K. Liao, Jackson County, Mo.

[73] Assignee: Nihon Kohsakuyu Company, Ltd., Japan

[21] Appl. No.: 627,086

[22] Filed: Jul. 2, 1984

Related U.S. Application Data

[63] Continuation-in-part of Ser. No. 474,305, Mar. 11, 1983, abandoned.

[30] Foreign Application Priority Data

Feb. 2, 1983 [JP] Japan ..... 58-014588

[51] Int. Cl.[4] ..... C10M 103/00

[52] U.S. Cl. ..... 252/32.5; 252/33.6; 252/42; 252/49.3

[58] Field of Search ..... 252/49.3, 32.5, 33.6, 252/42, 389 A

[56] References Cited

U.S. PATENT DOCUMENTS

| | | | |
|---|---|---|---|
| 2,917,459 | 12/1959 | Reamer | 252/49.3 |
| 3,983,098 | 9/1976 | Bussi et al. | 252/49.3 |
| 4,177,155 | 12/1979 | Popplewell et al. | 252/49.3 |
| 4,250,046 | 2/1981 | Przybylinski | 252/49.3 |
| 4,312,768 | 6/1982 | Nassry | 252/49.3 |
| 4,430,234 | 2/1984 | Hasegawa et al. | 252/49.5 |

FOREIGN PATENT DOCUMENTS

| | | | |
|---|---|---|---|
| 0069960 | 1/1983 | European Pat. Off. | 252/32.5 |
| 2351274 | 8/1974 | Fed. Rep. of Germany | 252/49.3 |

*Primary Examiner*—William R. Dixon, Jr.
*Assistant Examiner*—Cynthia A. Prezlock
*Attorney, Agent, or Firm*—Kokjer, Kircher, Bradley, Wharton, Bowman & Johnson

[57] ABSTRACT

A water soluble metalworking fluid is the subject of this invention. The fluid is utilized at a concentration of about 3 weight percent in aqueous solution. The active ingredients are comprised of disodium phosphate heptahydrate, sodium molybdate, sodium vanadate, 1,2,3-benzotriazole, a fluorinated hydrocarbon surfactant, a biocide, and a foam suppressant, all in aqueous solution. The resulting fluid is water soluble, transparent, film free, non-putrefying, non-toxic, a non-irritant, non-corrosive, non-polluting, and has very low BOD and COD values.

11 Claims, No Drawings

WATER SOLUBLE METALWORKING FLUIDS

This application is a continuation-in-part of Ser. No. 474,305, filed Mar. 11, 1983 now abandoned.

This invention relates generally to metalworking fluids and, more particularly, to a water soluble transparent fluid exhibiting superior physical and chemical properties.

Metalworking fluids have long been used in operations such as cutting, milling, drilling, and grinding. The purpose of the fluid is to lubricate, cool and remove chips, cuttings and dust.

Heretofore, metalworking fluids have largely been comprised of organic chemicals, principally petroleum derived substances. While the known metalworking fluids have generally performed satisfactorily, there are a number of disadvantages including: disposal problems where the fluid is not water soluble, relatively high BOD and COD values, possible health hazards (some active ingredients are known carcinogens), and the fact that the known organic fluids have been non-transparent thus masking the work to some degree when they are used.

Water is, of course, known to possess a number of properties that make it highly desirable as a cooling medium. These include a high specific heat, high thermal conductivity, and high heat of vaporization. Water is, however, a poor lubricant and promotes corrosion of most metals. While several water soluble inorganic compounds are known as corrosion inhibitors, they have not heretofore been utilized in combination to provide a metalworking fluid serving the multiple functions outlined above. Some of the inorganic corrosion inhibitors are also known to have critical concentration levels below which they will actually enhance corrosion. This becomes a problem when too much dilution occurs.

The present invention provides a metalworking fluid which is a combination of inorganic electrolytes having anticorrosion properties together with a fluorinated hydrocarbon surfactant. The combination has been found to exhibit synergistic properties by raising the lubricity of the combination to a practical level for a metalworking fluid.

It is, therefore, a primary object of the present invention to provide a metalworking fluid capable of performing the multiple functions required of such a fluid and which is water soluble.

An important aim of the invention is to provide a metalworking fluid capable of performing the multiple functions required of such a fluid and which is transparent and film free.

A very important objective of this invention is to provide a metalworking fluid which is non-putrefying.

One of the objects of the invention is to provide a metalworking fluid which is non-toxic and a non-irritant to human membranes and skin.

A further objective of the present invention is to provide a metalworking fluid which is non-corrosive.

A very important aim of the invention is to provide a metalworking fluid which is capable of disposal in a sanitary sewer system, is non-polluting, and has very low biochemical oxygen demand (BOD) and chemical oxygen demand (COD) values.

Still another objective of the invention is to provide a metalworking fluid meeting the foregoing aims and objects the active ingredients of which may be shipped and stored in powdered form before being diluted with water for use.

Other objects of the invention will be made clear or become apparent from the following description and claims.

In broadest form, the invention encompasses a metalworking fluid comprising 80–95% by weight of a sodium phosphate such as disodium phosphate heptahydrate, in combination with 5–20% by weight of a fluorinated hydrocarbon surfactant such as a $C_8$ hydrocarbon manufactured under the trademark Zonyl FSN-100 by the E. I. duPont deNemours and Company of Wilmington, Del. Another suitable fluorinated hydrocarbon surfactant is sold under the trademark Fluororad by The 3-M Company of Minneapolis, Minn. It is to be noted that the aforementioned fluroinated hydrocarbon surfactants have no significant lubricity alone. Where copper is to be encountered by the metalworking fluid, up to 0.5% by weight of 1,2,3-benzotriazole is added, based upon the total weight of the other active ingredients.

It has been discovered that the performance of the metalworking fluid will be further enhanced by the addition of one or both of the compounds sodium molybdate and sodium vanadate. In this case the preferred formulation for the active ingredients is 80–85% by weight of a sodium phosphate such as disodium phosphate heptahydrate and 15–20% by weight sodium molybdate and/or sodium vanadate. In addition 3 to 10 weight percent of fluorinated hydrocarbon surfactant is added, based upon the total weight of the other active components.

It is also desirable, but not necessary, to incorporate into the formulation a biocide, that is, a substance capable of killing microorganisms. Various commercial products are suitable for this purpose, including a hexahydro-1,3,5-tris(2-hydroxyethyl)-s-triazine, manufactured under the trademark GROTAN by the Sterling Drug Company of New York, N.Y. The biocide is incorporated in an amount equal to 4–8% by weight of the total weight of the other active components. It may also be desirable, but not necessary, to include in the composition a defoaming agent. Various commercial products are available, such as a 10% solution of polydimethylsiloxane-silica sold under the trademark DB 110-A by Dow Corning Corporation of Midland, Mich.

The foregoing components are all water soluble and should all be present in solution. The exact concentration of the solution is not critical, although generally a solution of approximately 3% by weight active ingredients and 97% water will be desirable. Concentrations as low as 1% have been shown to be effective and concentration as great as 5% may be practical in some applications.

A preferred formulation for the metalworking fluid of the invention is set forth below.

70–80% by weight disodium phosphate heptahydrate
6–8% by weight sodium molybdate
6–8% by weight sodium metavanadate
0.25–0.40% by weight 1,2,3-benzotriazole
2–5% by weight of a fluorinated hydrocarbon surfactant
3–5% by weight of a biocide
0.5–2% by weight of a foam suppressant The foregoing active components are present in a concentration of 3 weight percent in an aqueous solution. It has been found desirable to compound the formulation in solid form for shipment and storage. When the composition is to be used, it is diluted with water as indicated. The ability to store the composition for long periods of time as a powdered solid is a significant advantage over compositions of the prior art.

The following examples illustrate various embodiments of the invention that have been tested and proven effective.

EXAMPLE 1

Five test solutions were prepared utilizing 1.22 to 2.2% by weight/volume active ingredients in aqueous solution. The active ingredients comprised 10% by weight of a $C_8$ fluorinated hydrocarbon surfactant and 90% by weight disodium phosphate heptahydrate. The average failure load for the five test solutions, utilizing the Falex procedure is reported in Table 5.

EXAMPLE 2

A test solution comprising a 2.41 weight/volume percent aqueous solution of active ingredients was prepared according to the present invention. The active ingredients comprised 83% (by weight) disodium phosphate heptahydrate, 8.3% by weight $C_8$ fluorinated hydrocarbon surfactant, 8.3% by weight sodium molybdate and approximately 0.5% by weight 1,2,3-benzotriazole. The failure load for this solution utilizing the Falex procedure is reported in Table 5.

EXAMPLE 3

A test solution comprising a 2.5 weight/volume percent aqueous solution of active ingredients were prepared. The active ingredients comprised 83% by weight disodium phosphate heptahydrate, 8.3% by weight $C_8$ fluorinated hydrocarbon surfactant, 8.3% by weight sodium vanadate and approximately 0.5% by weight 1,2,3-benzotriazole. The failure load for this solution utilizing the Falex procedure is reported in Table 5.

EXAMPLE 4

Three test solutions comprising a 2.61 weight/volume percent aqueous solution of active ingredients were prepared according to the present invention. The active ingredients comprised 77% by weight disodium phosphate heptahydrate, 0.4% 1,2,3-benzotriazole, 7.7% each of sodium vanadate and sodium molybdate, and a $C_8$ fluorinated hydrocarbon which was varied in the three solutions from about 0.05% to 0.20%, by weight/volume. The average results of a Falex test on each of the three above solutions, is reported in Table 5.

Comparative lubricity testing was done to compare the improved metalworking fluid according to the present invention with other known compounds. The tests were conducted in accordance with ASTM Standard D3233-73(A) using a Falex machine. The test was carried to failurre as determined by the referenced ASTM Standard. The results of these tests are set forth in Tables 1 through 5.

TABLE 1

Falex Test Results of 1% (by weight) Inorganic Compounds in Deionized Water

| Compound | Failure Load (lbs.) |
|---|---|
| Deionized water (control) | 300 |
| Sodium silicate | 150 |
| Sodium nitrite | 303 |
| Borax | 310 |
| Boric acid | 300 |
| Sodium perborate | 350 |

TABLE 1-continued

Falex Test Results of 1% (by weight) Inorganic Compounds in Deionized Water

| Compound | Failure Load (lbs.) |
|---|---|
| Zinc nitrate | 260 |
| Calcium nitrate | 420 |
| Sodium hexametaphosphate | 270 |
| Sodium tripolyphosphate | 273 |
| Sodium molybdate | 613 |
| Magnesium sulfate | 637 |
| Sodium metavanadate | 1,233 |
| Sodium orthovanadate | 1,467 |
| Disodium Phosphate Heptahydrate | 2,016 |
| Trisodium phosphate | 1,725 |
| Zinc sulfate | 2,200 |

TABLE 2

Falex Test Results with 1% Inorganic Compounds in the Presence of 0.1% Zonyl FSN in Deionized Water

| | Failure Load (lbs) | | | | |
|---|---|---|---|---|---|
| Inorganic Compound | 1st | 2nd | 3rd | Average | Teeth Wear |
| $Na_2HPO_4.7H_2O$ | 3,150 | 3,700 | 3,400 | 3,083 | 24 |
| $Na_3VO_4$ | 2,100 | 2,000 | 2,100 | 2,067 | — |
| $NaVO_3$ | 2,350 | 2,350 | 2,150 | 2,283 | — |
| $MgSO_4$ | 3,550 | 3,550 | 3,650 | 3,583 | — |

Note:
Zonyl FSN is 40% (by weight) Zonyl FSN in isopropyl-alcohol. Substantial improvement of lubricity was later found with Zonyl FSN-100, which is the pure Zonyl, as indicated in Table 4.

TABLE 3

Falex Test Results with Mixtures of Disodium Phosphate and Zonyl FSN at Different Concentrations

| | Test Solution and Test Results | | | | | |
|---|---|---|---|---|---|---|
| Composition of Solution | No. 1 | No. 2 | No. 3 | No. 4 | No. 5 | No. 6[c] |
| $Na_2HPO_4.7H_2O$ (%) | 1 | 2 | 3 | 1 | 2 | — |
| Zonyl FSN (%) | 0.1 | 0.1 | 0.1 | 0.2 | 0.2 | — |
| Failure Load (lb)[a] | 3,083 | 3,600 | 3,500 | 4,050 | 4,400 | 4,117 |
| Teeth Wear[b] | 25 | — | — | 42 | — | 25 |

[a]Average value of three test runs
[b]Single test measurement
[c]Hangsterfer S-500/$H_2O$

TABLE 4

Falex Test Results with Mixtures of Disodium Phosphate and Zonyl FSN-100[a] at Different Concentrations

| Composition of Solution and Test | Test Solution and Test Results | | | | |
|---|---|---|---|---|---|
| | No. 1 | No. 2 | No. 3 | No. 4 | No. 5 |
| $Na_2HPO_4.7H_2O$ (%) | 2 | 1.67 | 1.43 | 1.25 | 1.15 |
| Zonyl FSN-100 (%) | 0.2 | 0.17 | 0.14 | 0.13 | 0.11 |
| Failure Load (lb)[b] | 4,483 | 4,360 | 4,306 | 4,340 | 3,250 |
| Teeth Wear[c] | 35 | 37 | 52 | 41 | — |

[a]Pure Zonyl FSN
[b]Average value of 3 test runs
[c]Single test measurement

TABLE 5

Falex Test Results of 1% (by weight) Aqueous Solution of Composition According to Invention

| Composition | Failure Load (lbs) |
|---|---|
| Example 1 | 4248 |
| Example 2 | 4422 |
| Example 3 | 4270 |
| Example 4 | 4349 |

Utilizing the foregoing test, the lubricity of the formula according to the present invention has been found to be greatly superior to any of the components individually.

Thus, the formulation according to the present invention provides noticeably superior performance in terms of lubricity while still meeting all of the objectives of the invention. Since the principal components of the formulation are inorganic substances, the problem of putrefaction of the composition, which has characterized most prior art fluids, is virtually eliminated. The biocide is incorporated into the formula of the invention only to prevent decomposition of organic contaminants encountered during use, especially from petroleum lubricants that may be present. The fact that the composition is water soluble, transparent, non-toxic and non-polluting is particularly advantageous.

I claim:

1. A composition for use as an active ingredient in a metalworking fluid, said composition comprising:

80–95% by weight disodium phosphate heptahydrate; and

5–20% by weight of a fluorinated hydrocarbon surfactant.

2. The composition of claim 1, wherein said composition further comprises 1,2,3-benzotriazole in a concentration of up to 0.5% by weight, based on the total weight of the other active components.

3. The composition of claim 2, wherein said composition further comprises 4 to 8% by weight of a biocide, based on the total weight of the other active components.

4. The composition of claim 3, wherein said composition further comprises a foam suppressant.

5. A composition for use as an active ingredient in a metalworking fluid, said composition comprising:

70–85% by weight disodium phosphate heptahydrate;

7–20% by weight of at least one of the compounds sodium molybdate and sodium vanadate; and 3–10% by weight, based on the total weight of the other components, of a fluorinated hydrocarbon surfactant.

6. The composition of claim 5, wherein said sodium vanadate comprises sodium metavanadate.

7. The composition of claim 5, wherein said composition is present in aqueous solution in a quantity of approximately 3 weight percent.

8. The composition of claim 5, wherein said composition further comprises 1,2,3-benzotriazole, in a concentration of up to 0.5% by weight based on the total weight of the other active components.

9. The composition of claim 5, wherein said composition further comprises 4 to 8% by weight of a biocide, based on the total weight of the other active components.

10. A metalworking fluid comprising:

70–80% by weight disodium phosphate heptahydrate;

12–16% by weight of at least one of the compounds sodium molybdate and sodium metavanadate;

0.25–0.5% by weight 1,2,3-benzotriazole;

2–5% by weight of a fluorinated hydrocarbon surfactant;

3–5% by weight of a biocide; and 0.5–2% by weight of a foam suppressant, the foregoing being present in aqueous solution.

11. The composition of claim 10, wherein said solution comprises 95–97% by weight water.

* * * * *